US006360932B1

(12) United States Patent
Liu et al.

(10) Patent No.: US 6,360,932 B1
(45) Date of Patent: Mar. 26, 2002

(54) STRAP FEEDING AND WITHDRAWING STRUCTURES OF AN UPRIGHT BINDING MACHINE

(75) Inventors: Chin-Chang Liu, Taichung; Chi-Chan Su, Taipei, both of (TW)

(73) Assignees: Tekpak Corporation, Taichung; Transpak Equipment Corporation, Taipei, both of (TW)

( * ) Notice: Subject to any disclaimer, the term of this patent is extended or adjusted under 35 U.S.C. 154(b) by 0 days.

(21) Appl. No.: 09/649,871

(22) Filed: Aug. 28, 2000

(51) Int. Cl.[7] ..... G03B 1/56; B65B 67/08
(52) U.S. Cl. ..... 226/90; 53/592; 100/3
(58) Field of Search ..... 226/90, 89; 100/3; 53/589, 592

(56) References Cited

U.S. PATENT DOCUMENTS 3,691,939 A * 9/1972 Goodley ..... 100/2
3,834,297 A * 9/1974 Huson ..... 100/3
5,377,477 A * 1/1995 Haberstroh et al. ..... 53/589 X
6,041,698 A * 3/2000 Chin-Chang et al. ..... 53/589 X
6,145,286 A * 11/2000 Huber ..... 53/589

* cited by examiner

*Primary Examiner*—Michael R. Mansen
(74) *Attorney, Agent, or Firm*—Harrison & Egbert

(57) ABSTRACT

An upright binding machine including a machine stand on which a strap feeding wheel device is mounted to facilitate the binding of an article. The machine stand is further provided with a strap withdrawing structure including a transmission member for actuating a connection rod to cause a first slide block and a second slide block to displace such that the first slide block causes a main strap feeding wheel to separate from a secondary strap feeding wheel. The second slide block is linked with the first slide block so as to enable a frame body to actuate a strap guiding frame and the secondary strap feeding wheel to move upwards to enable the binding strap to move away from the article.

2 Claims, 16 Drawing Sheets

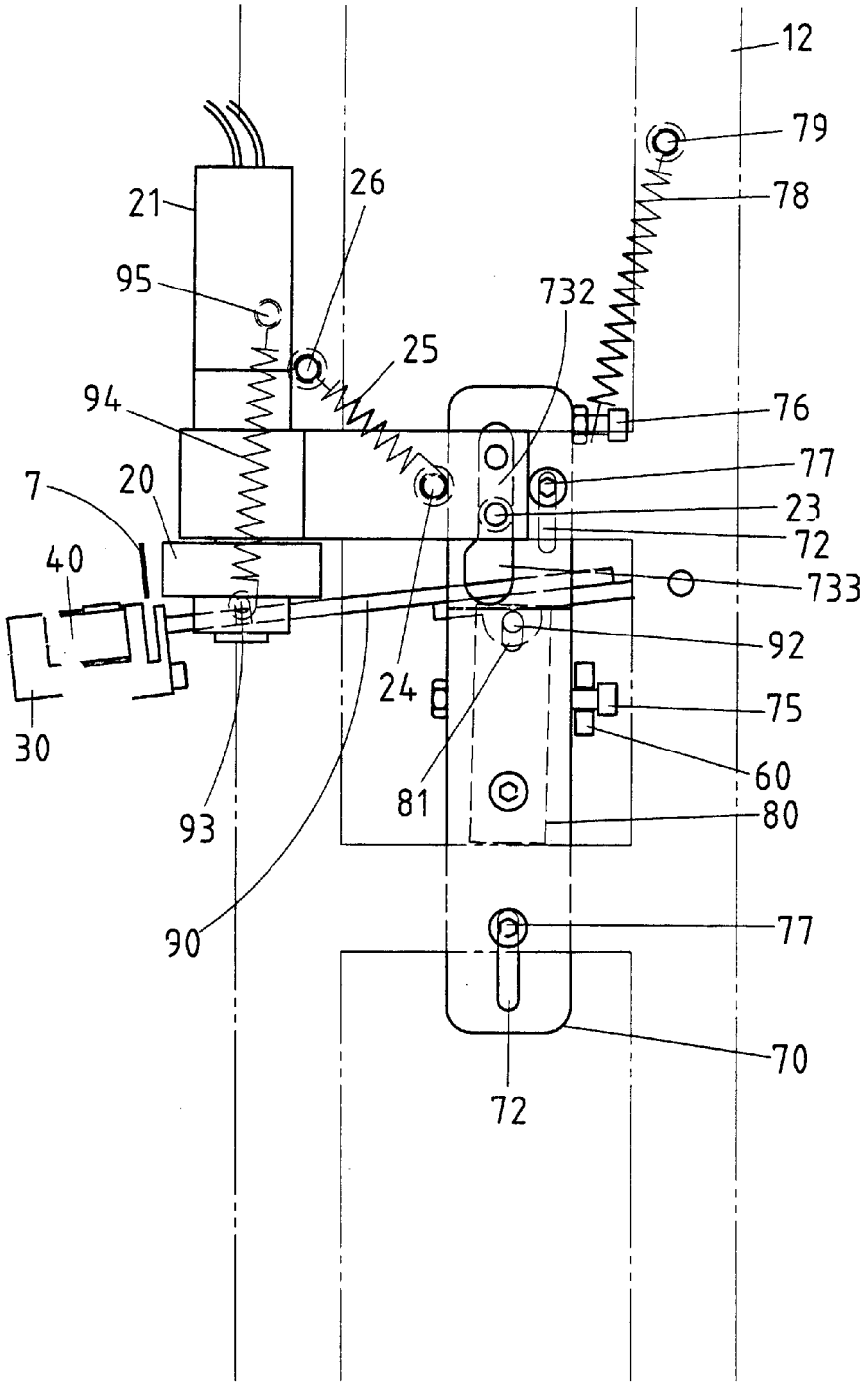
FIG.12--1

STRAP FEEDING AND WITHDRAWING STRUCTURES OF AN UPRIGHT BINDING MACHINE

BACKGROUND OF THE INVENTION

1. Field of the Invention

The present invention relates generally to an upright binding machine, and more particularly to a strap feeding structure and a strap withdrawing structure of the upright binding machine.

2. Description of Related Art

As shown in FIGS. 1 and 2, an upright binding machine 10 of the prior art has a strap feeding port 2 which is located in the strap guiding slot 5 of the face plate 4 of the machine body 3. The upright binding machine 10 further has a platform 6 on which an article 1 is placed for being fastened around with a binding strap 7. If the article 1 is relatively large, the strap feeding port 2 is easily obstructed by the article 1, thereby resulting in operational inconvenience.

BRIEF SUMMARY OF THE INVENTION

The primary objective of the present invention is to provide an upright binding machine with a strap feeding structure and a strap withdrawing structure, which are free of the deficiency of the upright binding machine of the prior art described above.

The objective, technique, features and functions of the present invention will be readily understood upon a thoughtful deliberation of the following detailed description of the present invention with reference to the accompanying drawings.

BRIEF DESCRIPTION OF THE SEVERAL VIEWS OF THE DRAWINGS

FIG. 10-1 shows a top schematic view of the present invention.

FIG. 11-1 shows a top schematic view of the main strap feeding wheel of the present invention at work.

FIG. 12-1 shows a schematic view of the strap guiding frame and the secondary strap feeding wheel of the present invention in operation.

DETAILED DESCRIPTION OF THE INVENTION

Figure 1:
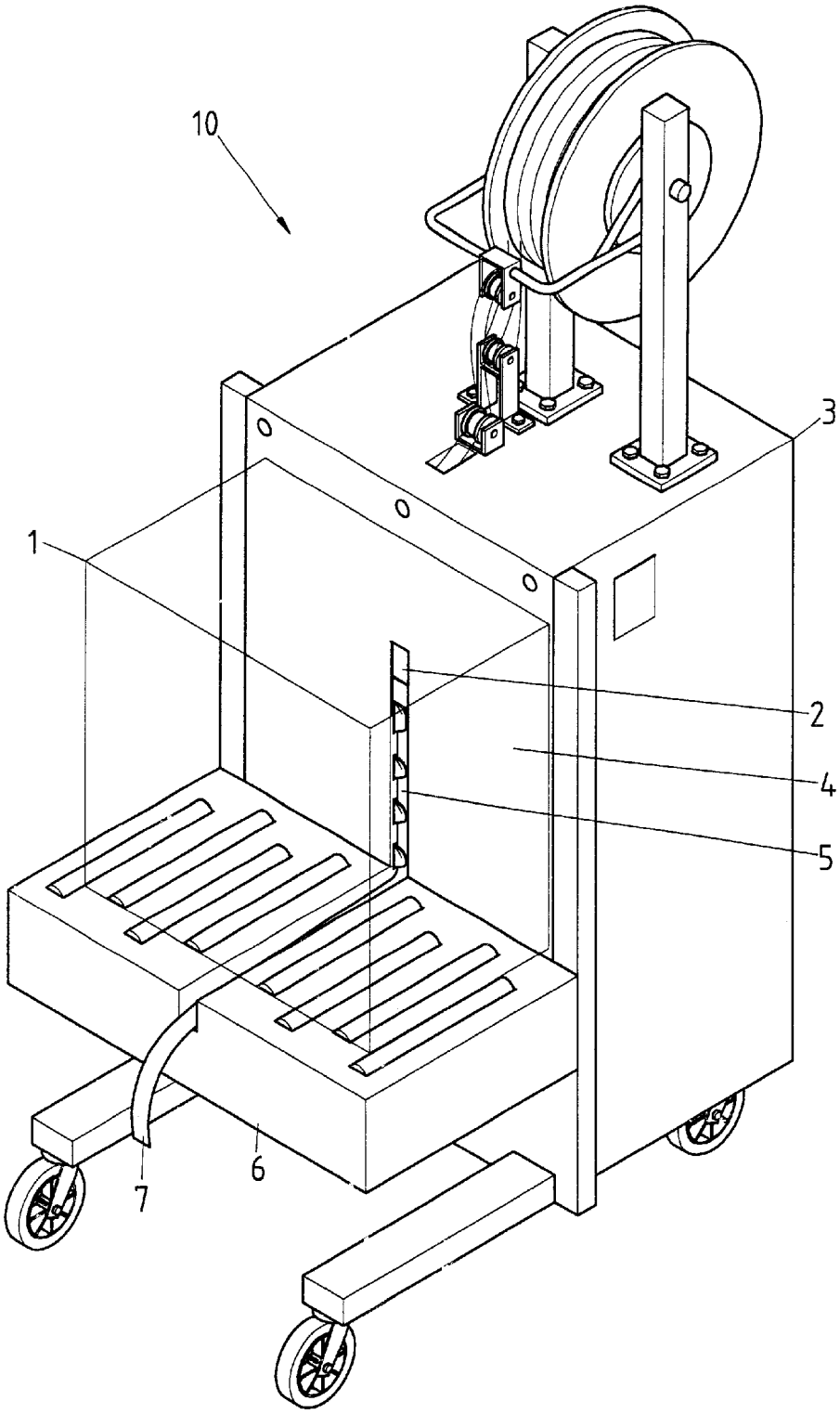
FIG.1 PRIOR ART
FIG. 1 shows a perspective view of an upright binding machine of the prior art.
Figure 2:
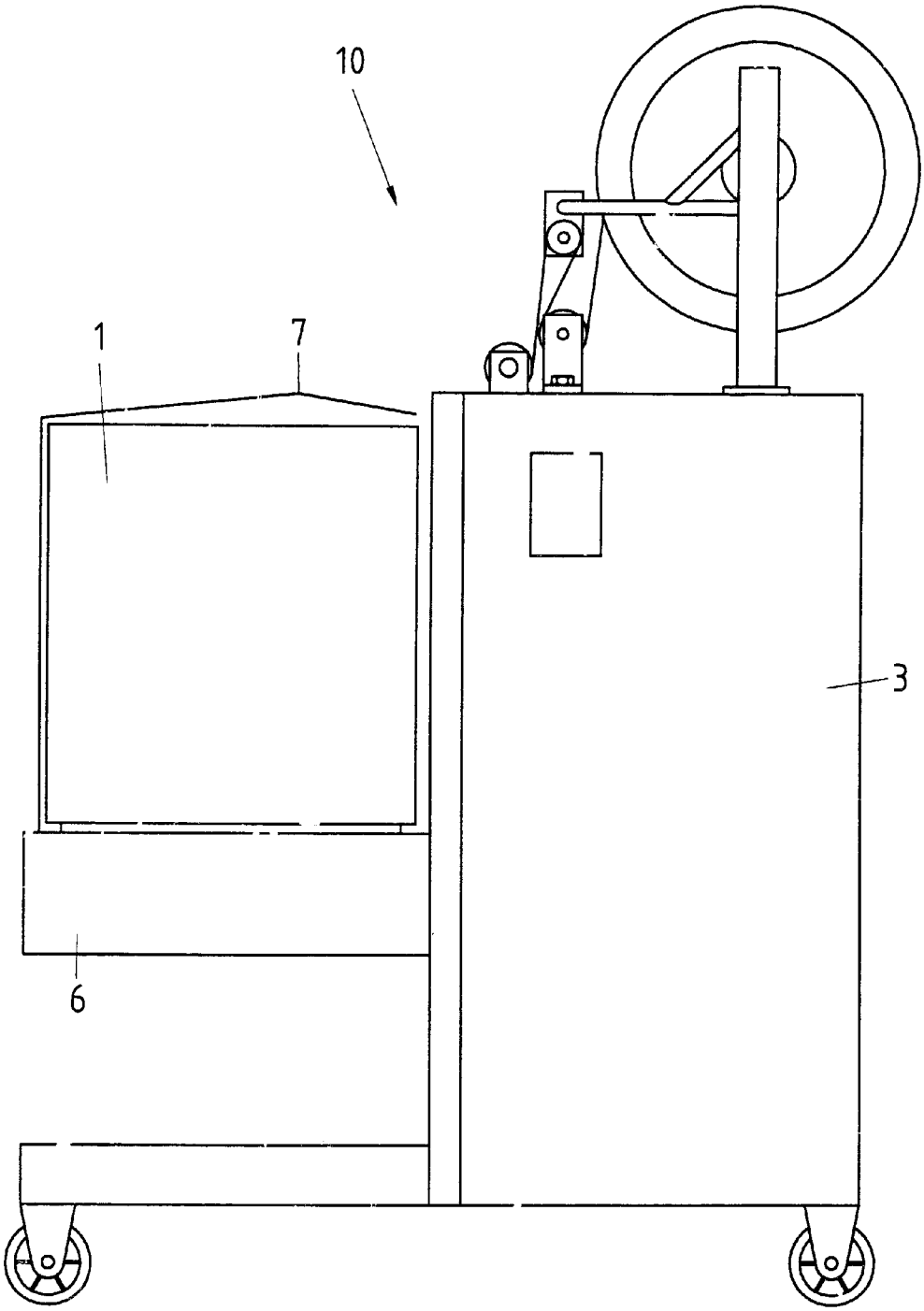
FIG. 2 PRIOR ART
FIG. 2 shows a side schematic view of the upright binding machine of the prior art.
Figure 3:
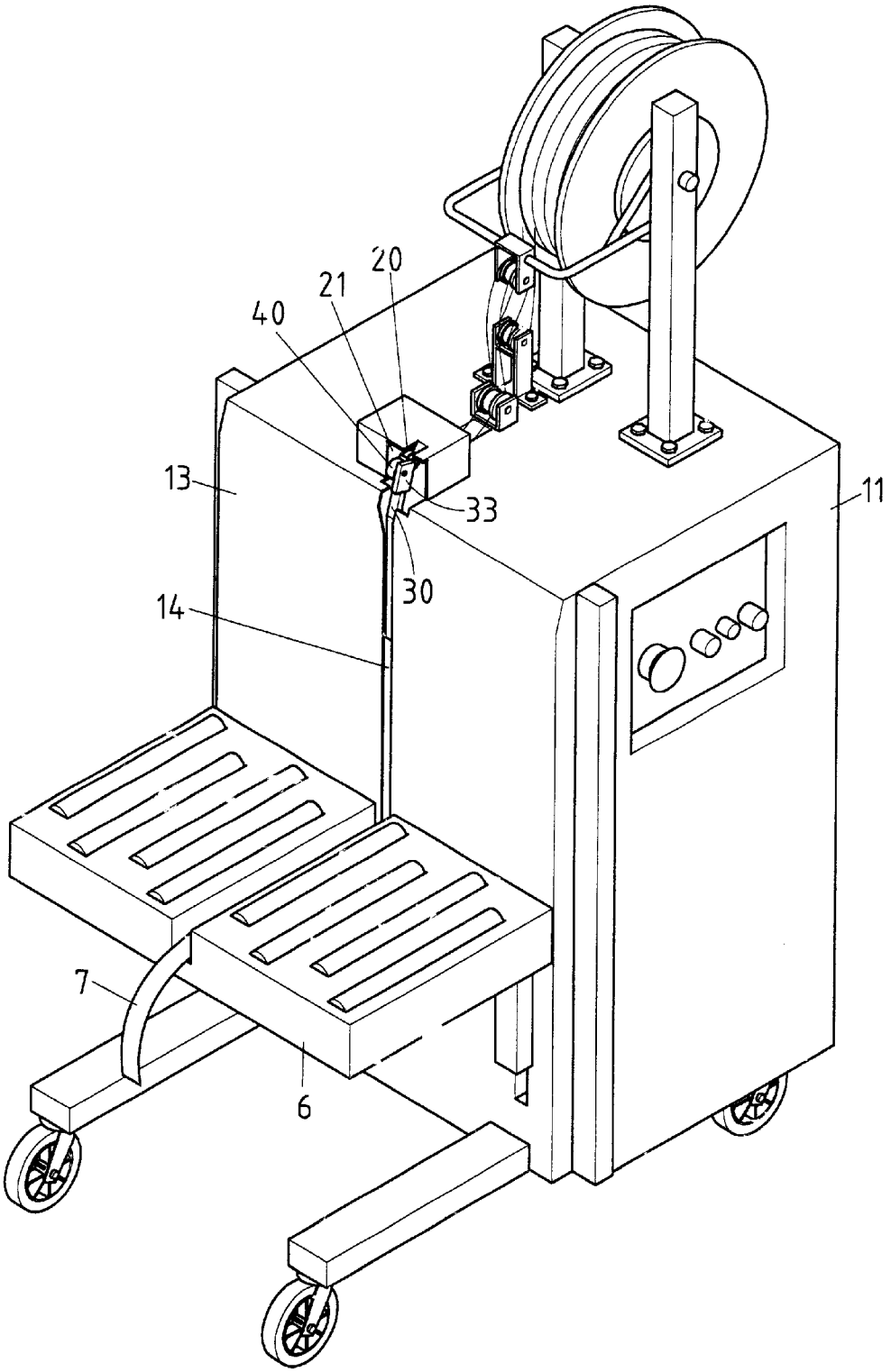
FIG. 3 shows a perspective view of an upright binding machine of the present invention.
Figure 4:
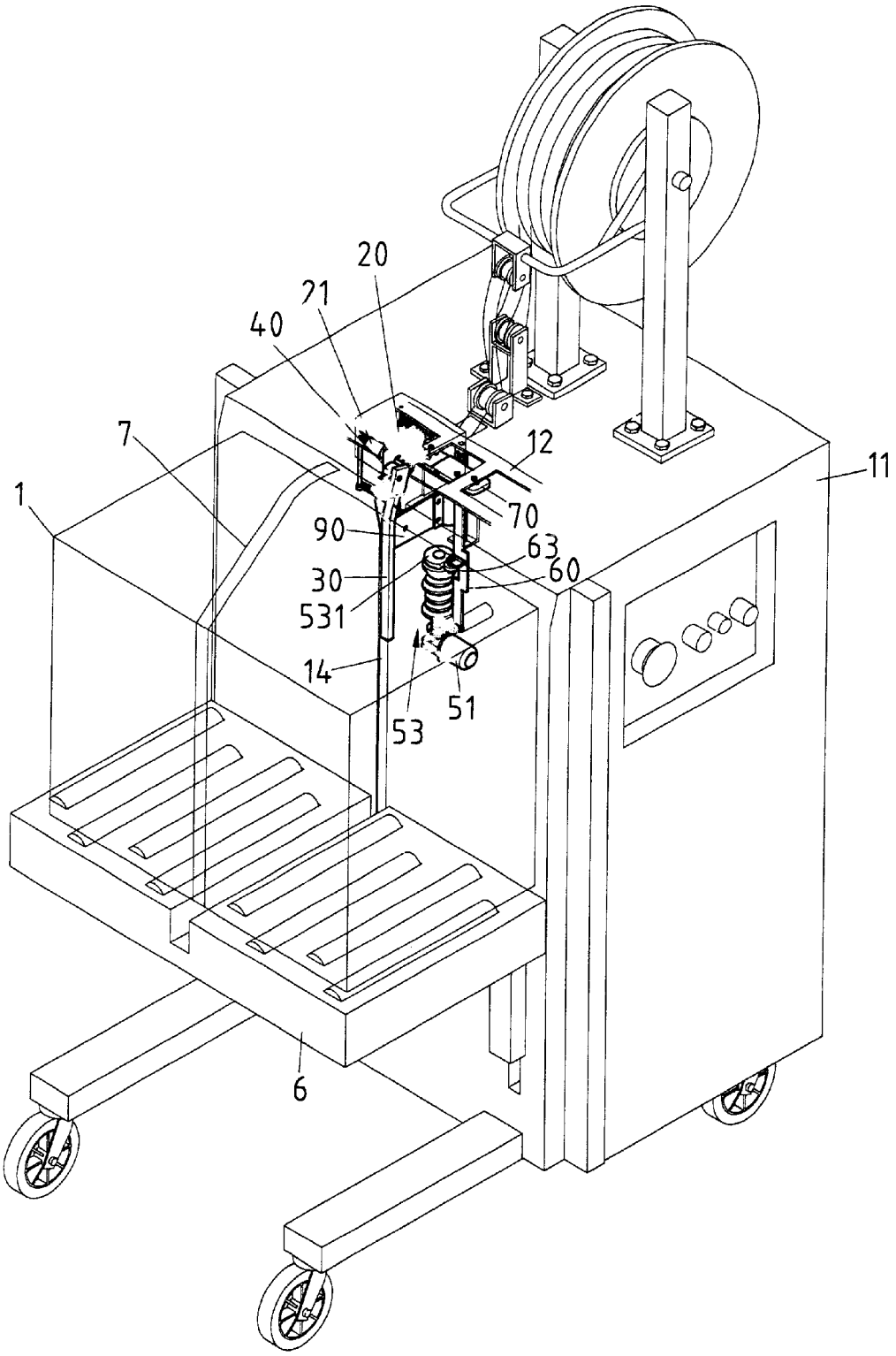
FIG. 4 shows a schematic view of the upright binding machine of the present invention in operation.
Figure 5:
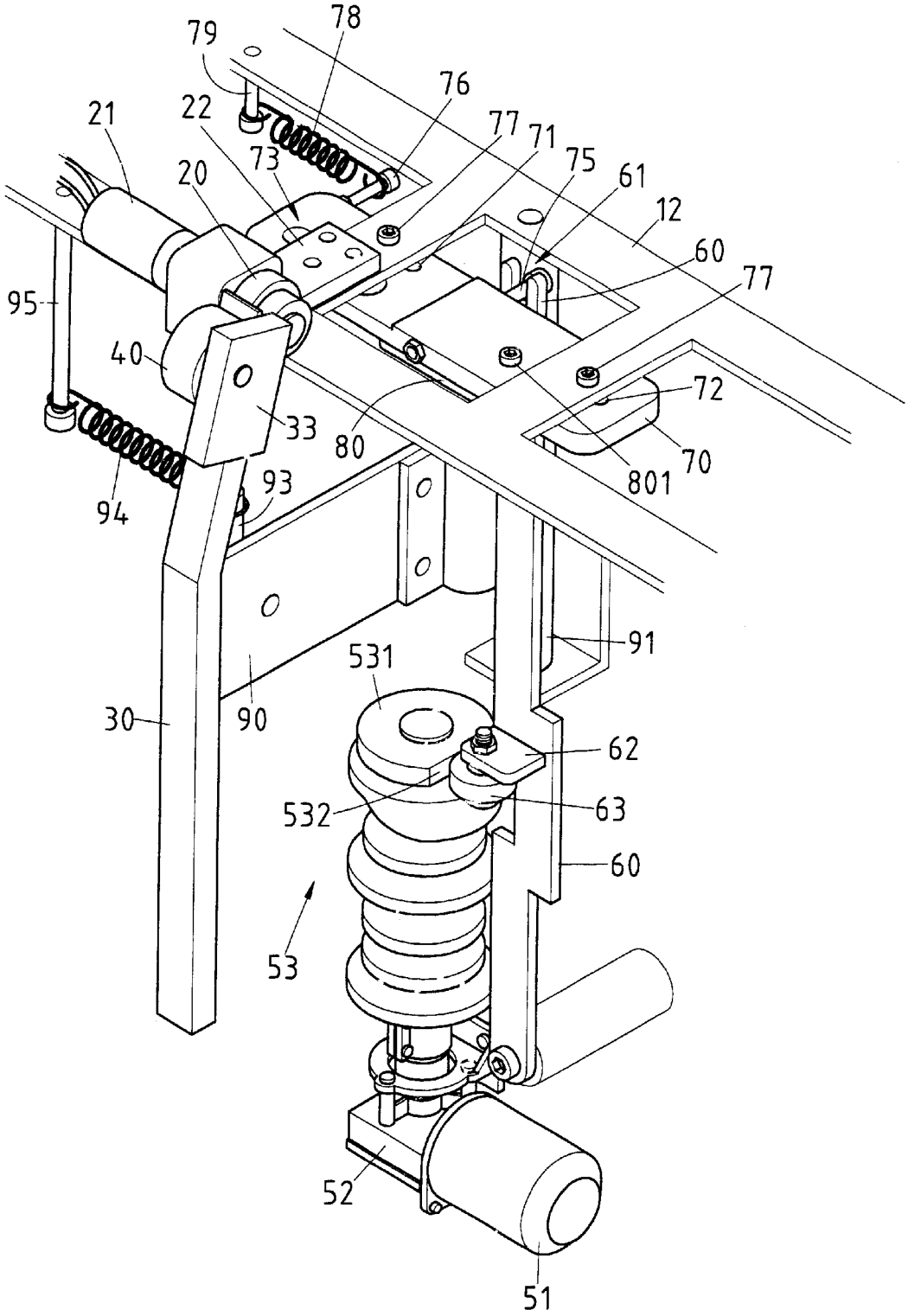
FIG. 5 shows a partial enlarged view of the upright binding machine of the present invention.
Figure 6:
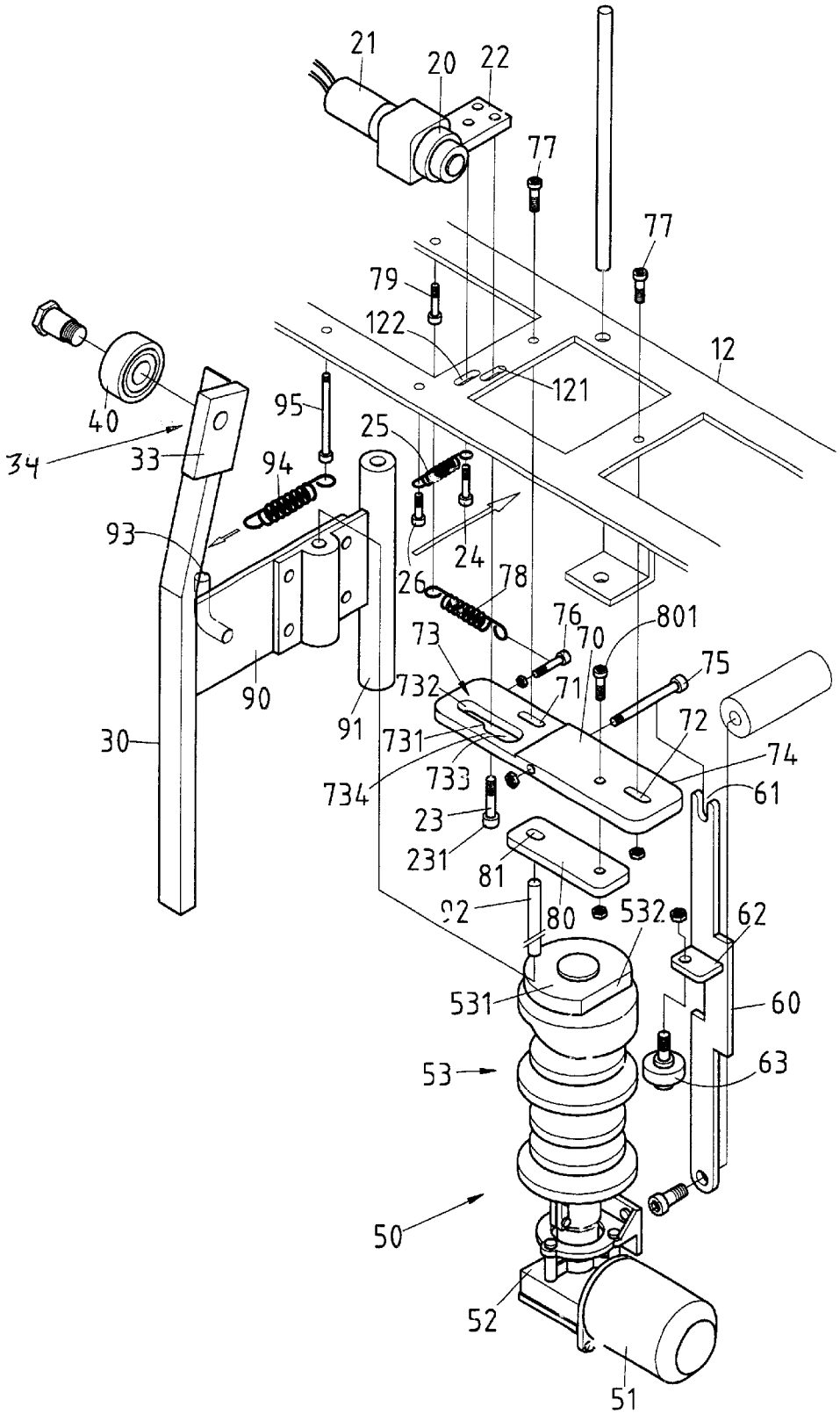
FIG. 6 shows an exploded view of the upright binding machine of the present invention.
Figure 6A:
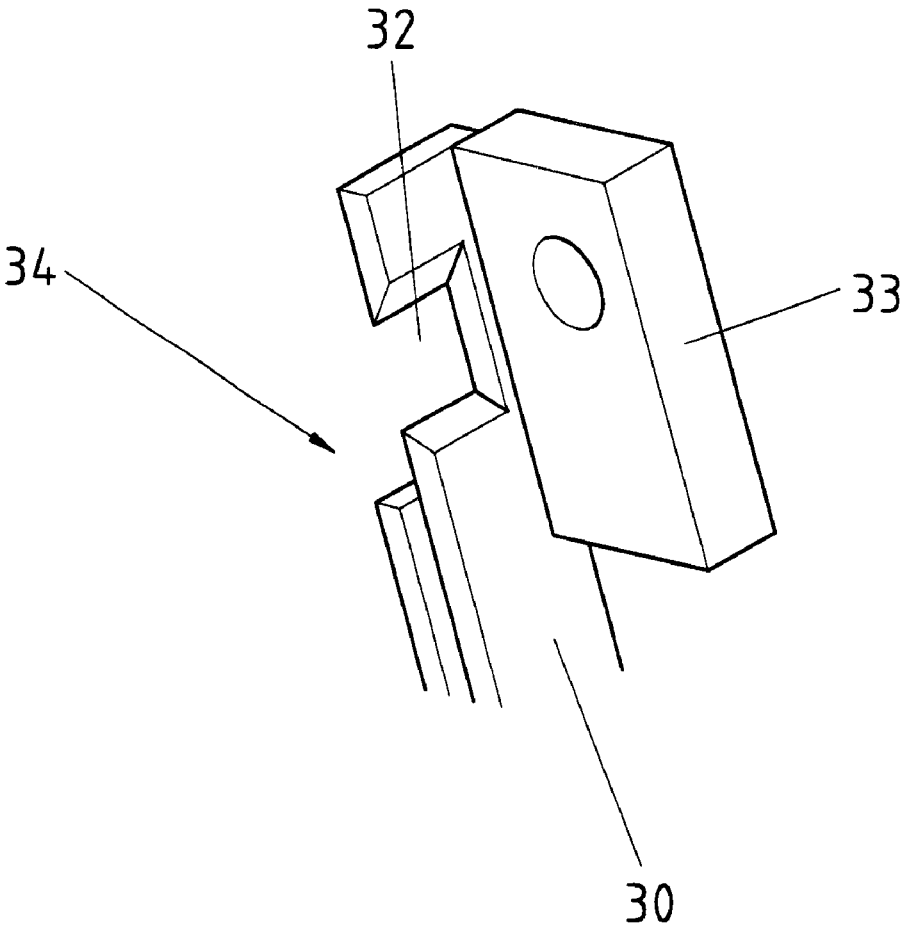
FIG. 6A shows a perspective view of the top end of the strap guiding frame.

As shown in FIGS. 3–6, a strap feeding structure of the upright binding machine of the present invention comprises a main strap feeding wheel 20, a strap guiding frame 30, and a secondary strap feeding wheel 40.

The main strap feeding wheel 20 is driven by a motor 21 and connected with a seat plate 22 which is mounted on a support plate 12 of a machine stand 11.

The strap guiding frame 30 is longitudinally disposed and is connected at the midsegment of the inner side thereof with a support body 90 which is fastened pivotally to the machine stand 11. The strap guiding frame 30 is provided in the proximity of the top end 34 thereof with a through hole 32 and a block body 33 fastened thereto. The strap guiding frame 30 is disposed in a longitudinal hole 14 of the face plate 13 in front of the machine stand 11.

The secondary strap feeding wheel 40 is pivoted with the block body 33 of the strap guiding frame 30 such that the secondary strap feeding wheel 40 is in contact with the main strap feeding wheel 20 via the through hole 32 of the strap guiding frame 30.

A strap withdrawing structure of the upright binding machine of the present invention comprises a transmission member 50, a connection rod 60, a first slide block 70, a second slide block 80, and a frame body 90.

The transmission member 50 is disposed in the interior of the machine stand 11 and is formed of an upright cam shaft 53 which is driven by a motor 51 via a decelerator 52. The upright cam shaft 53 is provided at the top end with a cam 531, and in the outer periphery with a tangent plane 532.

The connection rod 60 is uprightly disposed and is provided at the top end with an indentation 61. The connection rod 60 is pivoted at the bottom end with the machine stand 11. The connection rod 60 is provided at the midsegment with a protruded piece 62 fastened thereto. A pulley 63 is pivoted with the connection rod 60 such that the pulley 63 is in contact with the cam 531. The connection rod 50 is actuated to swivel by means of the transmission member 50.

The first slide block 70 is horizontally disposed and is provided with a first through hole 71, a second through hole 72, and a guide hole 73, which are all parallel to the longitudinal direction the first slide block 70. The guide hole 73 has a small diametrical end 732 and a large diametrical end 733. The first slide block 70 is further provided in a longitudinal side 74 with a position controlling bolt 75 and a retrieving bolt 76. The first slide block 70 is fastened to the support plate 12 by two fastening screws 77 which are fastened onto the support plate 12 via the first through hole 71 and the second through hole 72. The position controlling bolt 75 is retained in the indentation 61 of the top end of the connection rod 60. The retrieving bolt 76 catches one end of a spring 78 which is engaged at another end thereof with a locating bolt 79 fastened to the support plate 12. The support plate 12 is provided with a first guiding hole 121 and a second guiding hole 122, which correspond in location to the small diametrical end 732 of the guide hole 73 of the first slide block 70 and are parallel to the short axis of the first slide block 70. The seat plate 22 of the main strap feeding wheel 20 is disposed on the support plate 12. A position guiding bolt 23 is fastened onto the seat plate 22 of the main strap feeding wheel 20 via the large diametrical end 733 of the guide hole 73 and the first guiding hole 121 of the support plate 12. A pulley 231 is in contact with a longitudinal hole wall 734 of the guide hole 73, which is provided with a stepped edge 731. A bolt 24 is fastened onto the seat plate 22 of the main strap feeding wheel 20 via the second guiding hole 122 of the support plate 12 such that the bolt 24 catches one end of a spring 25 whose other end is retained by a screw 26 fastened onto the support plate 12.

The second slide block 80 is horizontally fastened to the first slide block 70 by a screw 801 and is provided with a long hole 81 parallel to the longitudinal direction of the second slide block 80 and contiguous to the guide hole 73 of the first slide block 70.

The frame body 90 is fastened at one end to the midsegment of the strap guiding frame 30 and is provided at another end with an upright shaft tube 91 which is pivoted with the interior of the machine stand 11. The frame body 90 is provided in the midsegment with a bolt body 92 which is inserted into the long hole 81 of the second slide block 80. The frame body 90 is provided with an upright rod body 93 which catches one end of a spring 94 which is caught at another end thereof by an upright projection 95 extending from the support plate 12.

Figure 7:
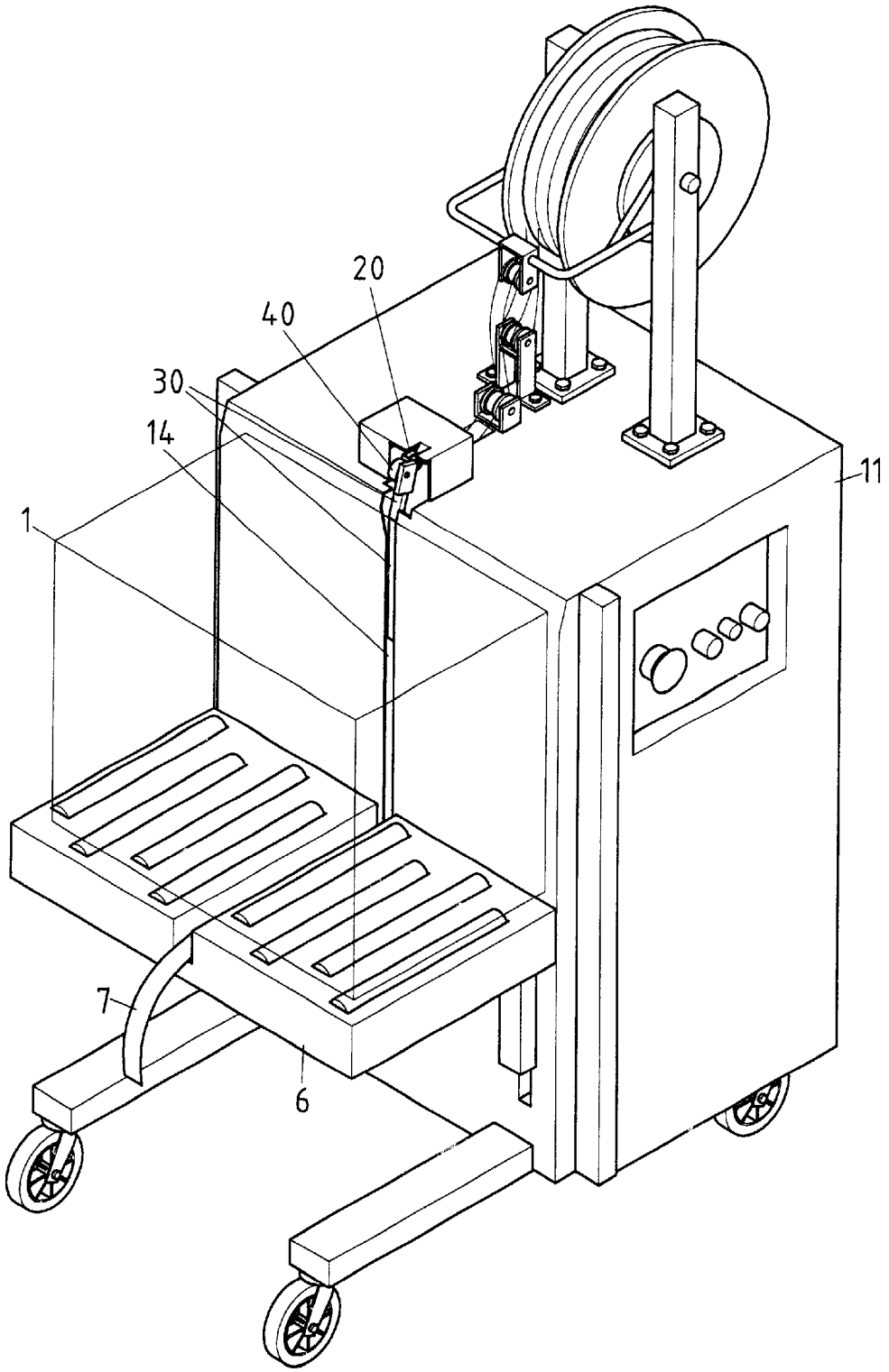
FIG. 7 shows a schematic view of the upright binding machine of the present invention in operation.
Figure 8:
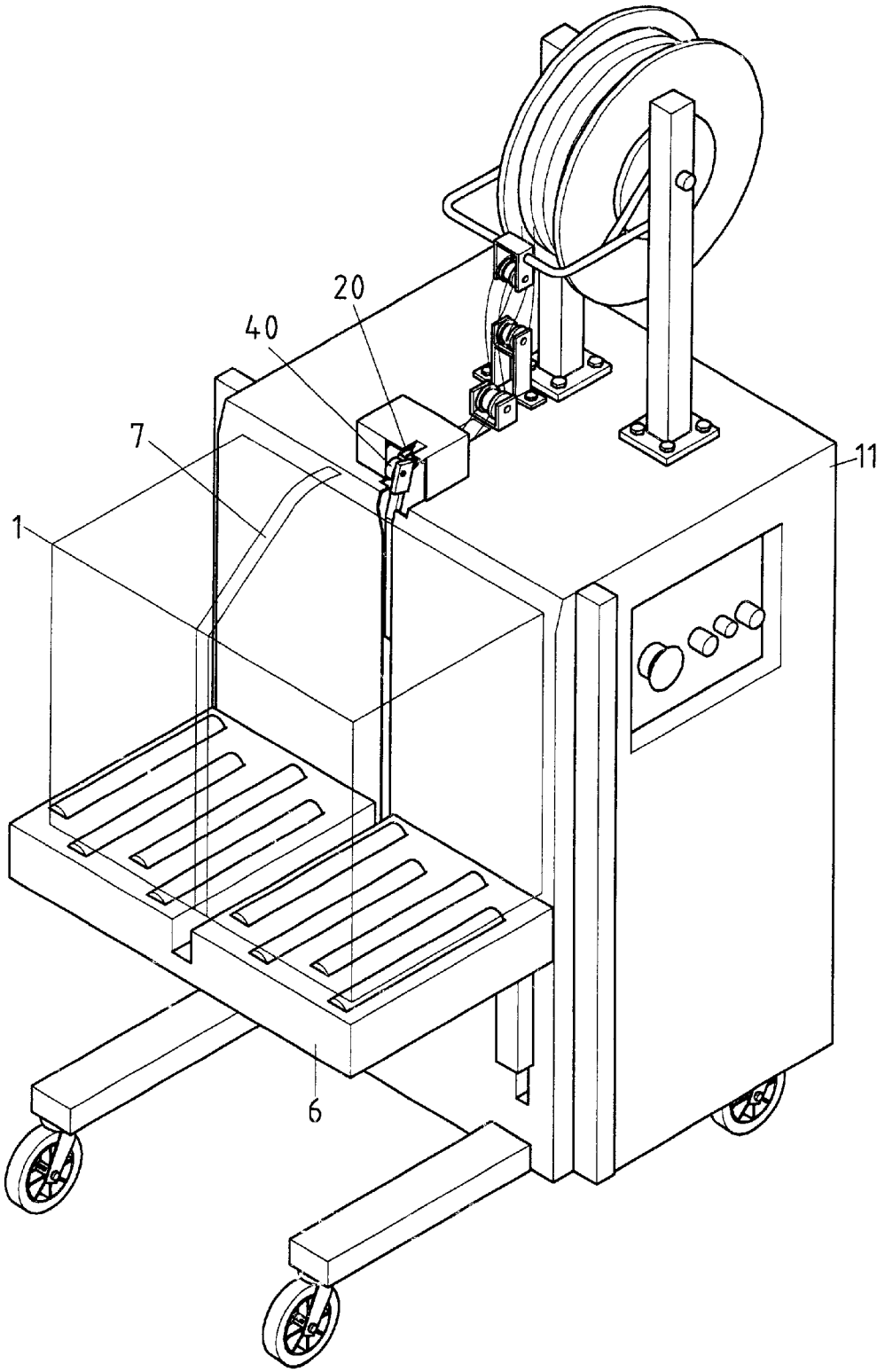
FIG. 8 shows another schematic view of the upright binding machine of the present invention in operation.
Figure 9:
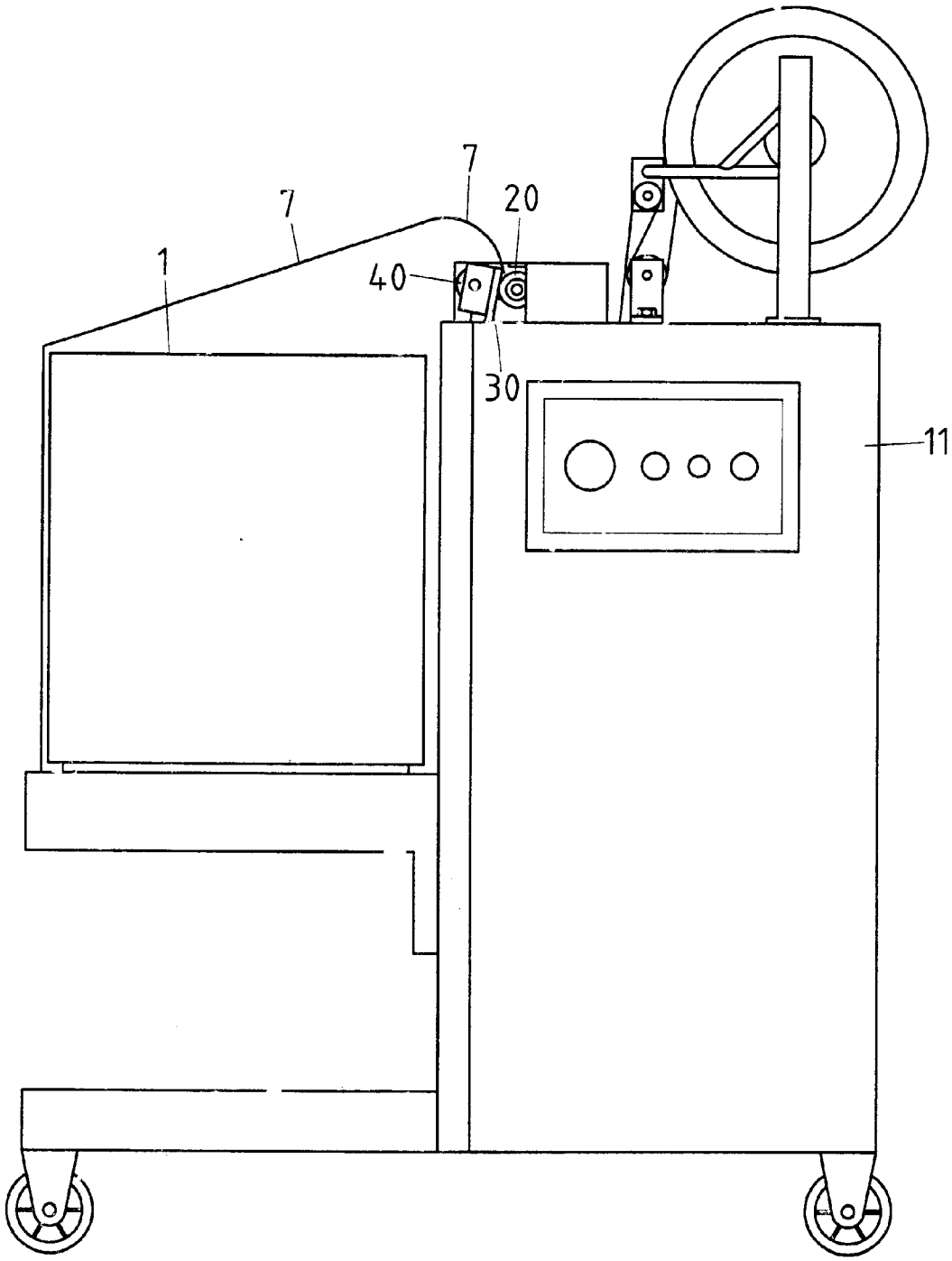
FIG. 9 shows a side schematic view of the upright binding machine of the present invention in operation.
Figure 10:
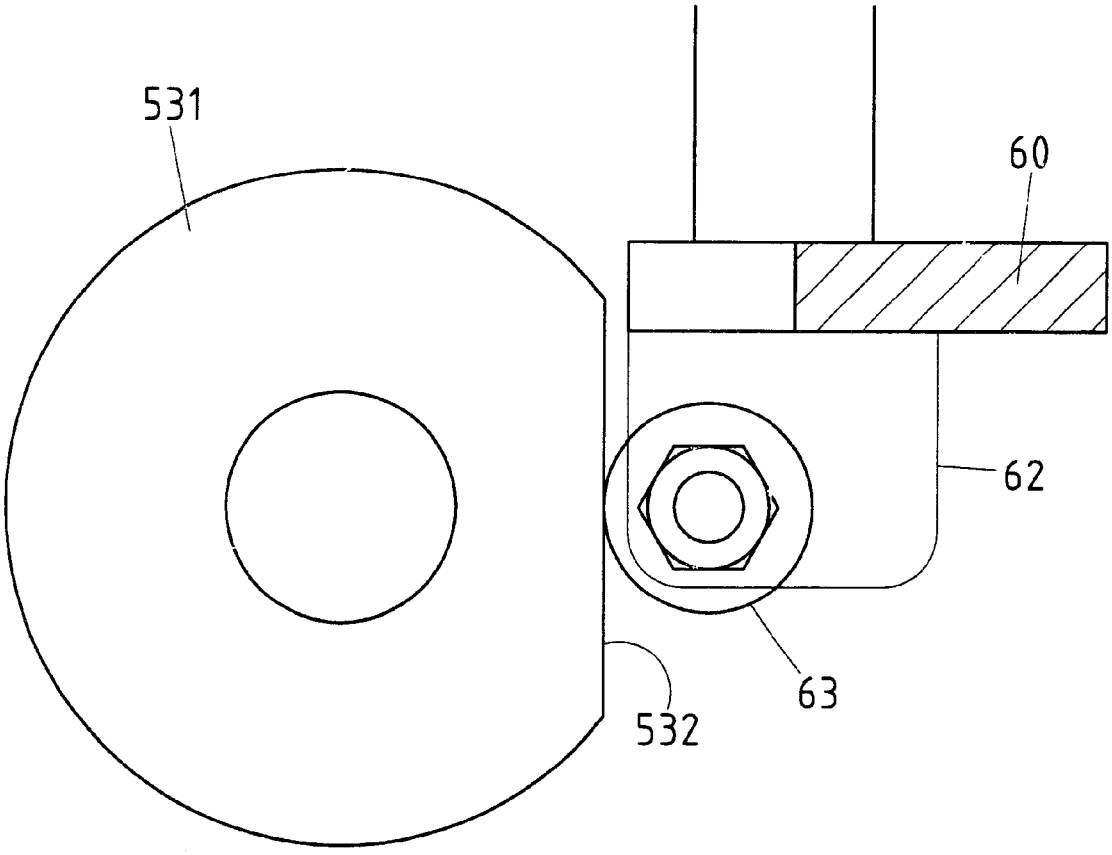
FIG. 10 shows a top schematic view of the cam, the pulley, and the connection rod of the present invention.
Figures 1, 10:
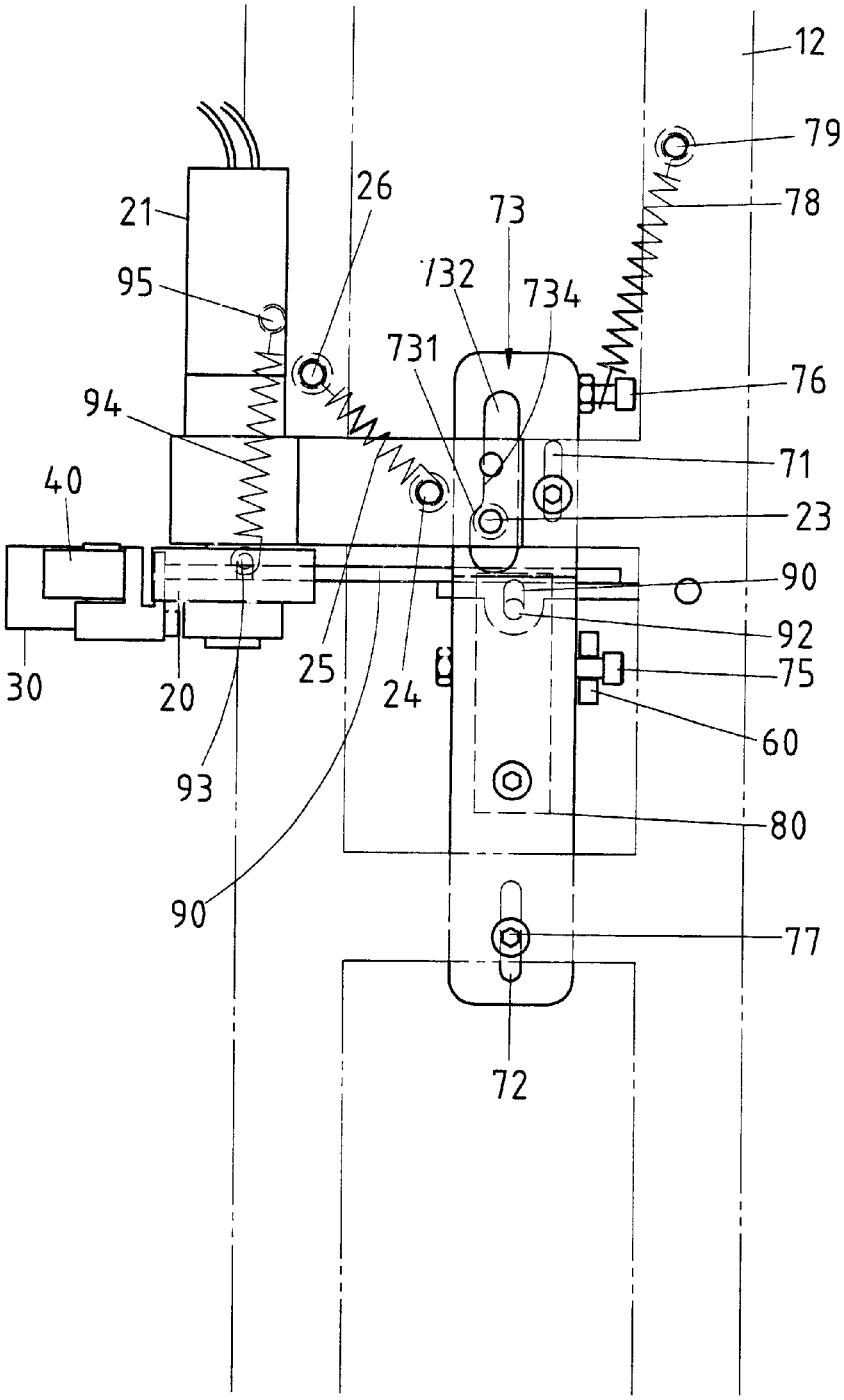
Figure 11:
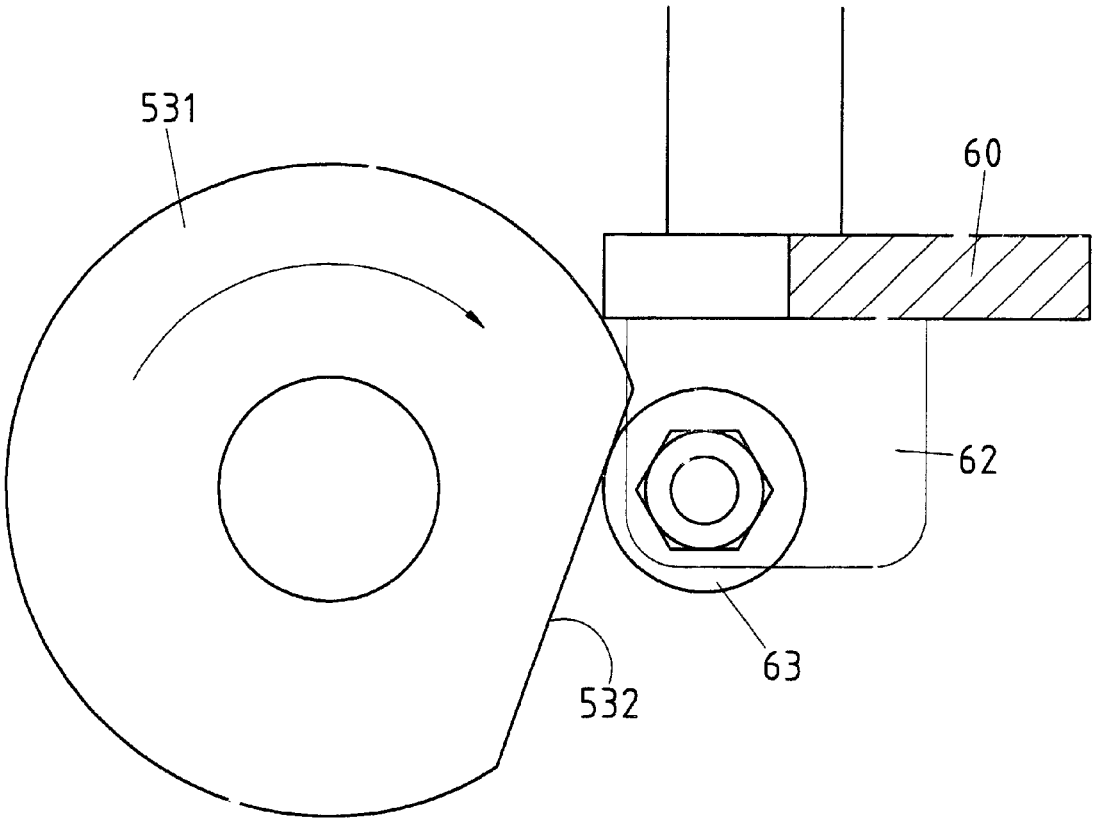
FIG. 11 shows a schematic view of the linkage relationship of the cam, the pulley and the connection rod of the present invention in operation.
Figures 1, 11:
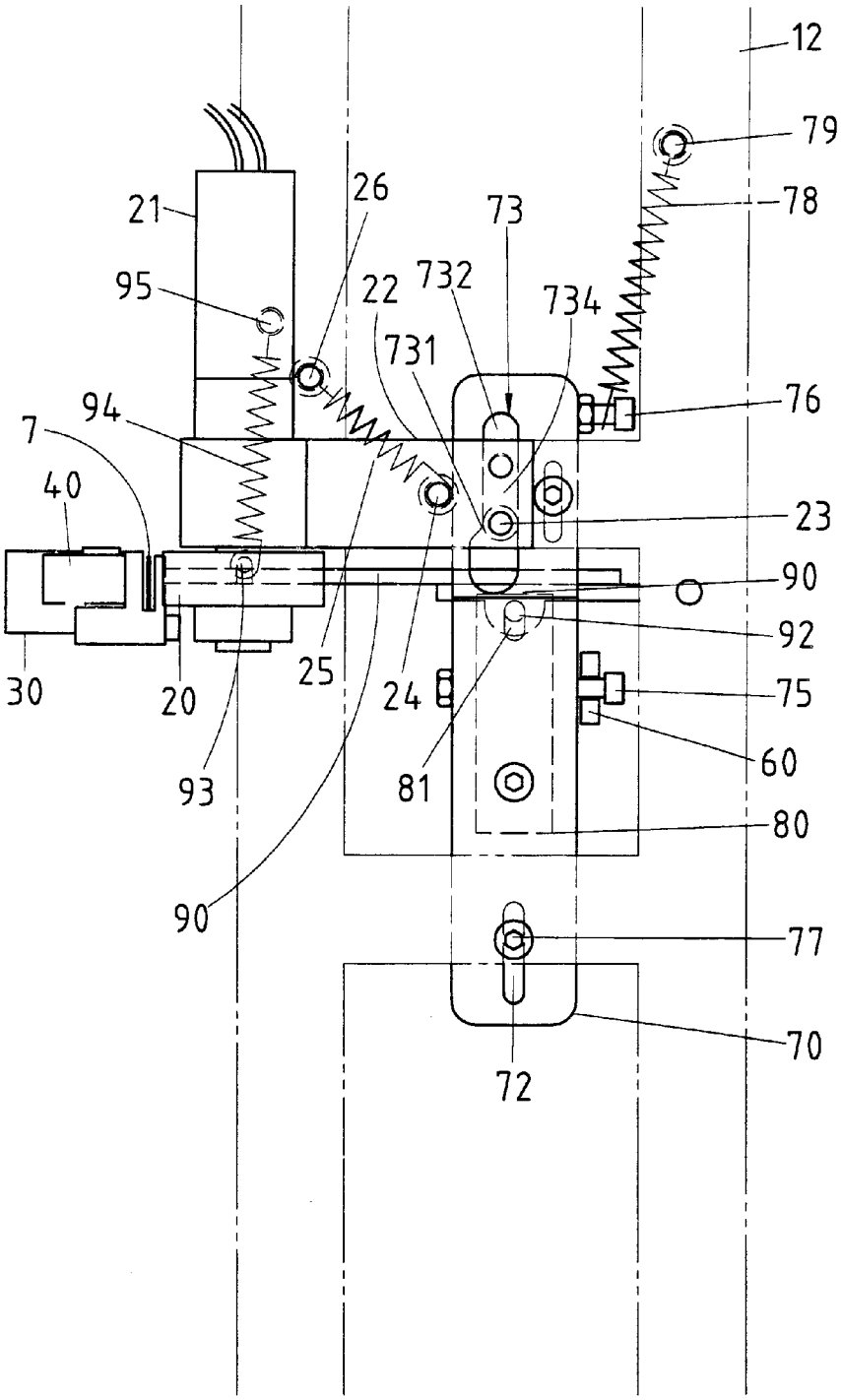
Figure 12:
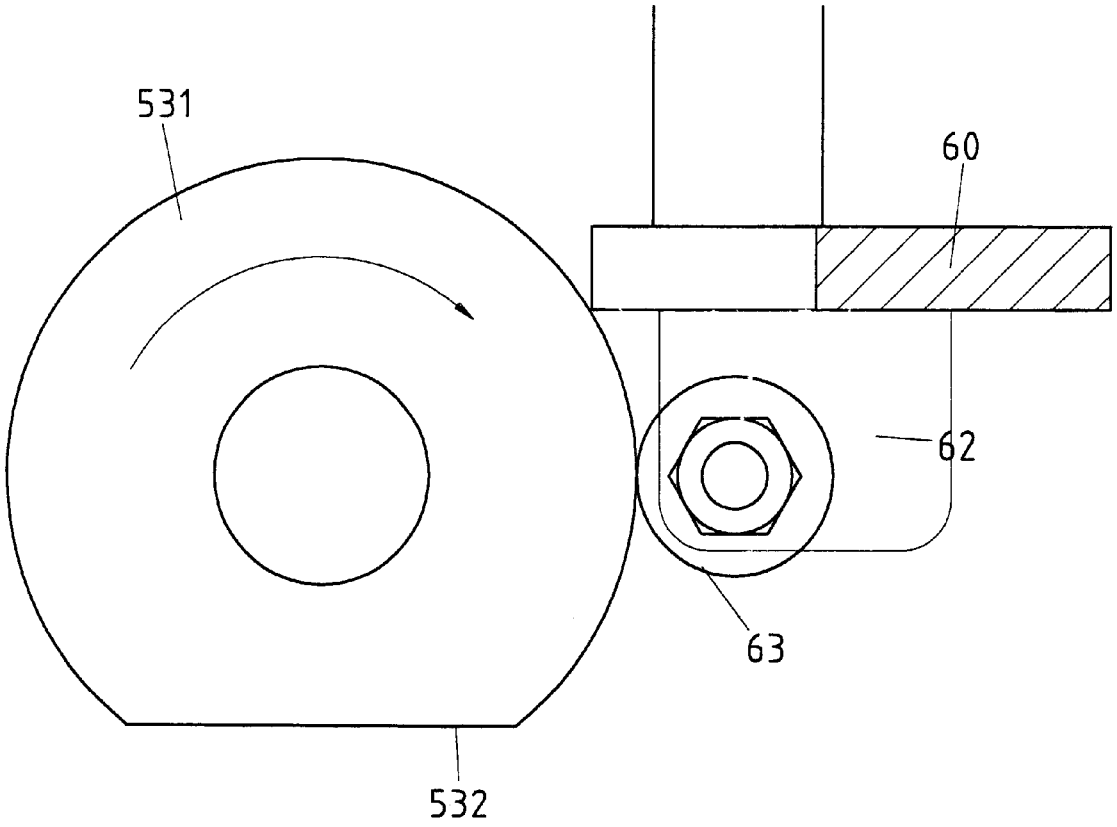
FIG. 12 shows a schematic view of the linkage relationship of the cam, the pulley and the connection rod at the time when the secondary strap feeding wheel of the present invention is in operation.

As illustrated in FIGS. 7, 8, and 9, the free end of a binding strap 7 of the upright binding machine 10 of the present invention can be pulled to locate between the main strap feeding wheel 20 and the secondary strap feeding wheel 40, thereby preventing the strap feeding operation from being obstructed by an article 1 which is to be made fast.

As shown in FIGS. 5, 6, 10, 10-1, 11, 11-1, 12, and 12-1, the binding strap 7 can be easily separated from the binding machine 10 in view of the fact that the main strap feeding wheel 20 is linked with the seat plate 22 so as to move away from the secondary strap feeding wheel 40, and that the first slide block 70 is linked with the second slide block 80 to enable the frame body 90 to actuate the strap guiding frame 30 and the secondary strap feeding wheel 40 to move outwards, thereby enabling the binding strap 7 to move away from the article 1.

We claim:

1. A strap feeding structure of an upright binding machine comprising:

a main strap feeding wheel driven by a motor and connected with a seat plate which is mounted on a support plate of a machine stand, said machine stand provided with a face plate having a longitudinal hole;

a strap guiding frame disposed in said longitudinal hole of said face plate and connected at a midsegment thereof with a support body which is fastened pivotally to said machine stand, said strap guiding frame being provided with a through hole and a block body fastened thereto; and a secondary strap feeding wheel pivoted with said block body of said strap guiding frame such that said secondary strap feeding wheel is in contact with said main strap feeding wheel via said through hole of said strap guiding frame.

2. A strap withdrawing structure of an upright binding machine comprising:

a transmission member disposed in an interior of a machine stand and formed of an upright cam shaft driven by a motor via a decelerator, said upright cam shaft provided at a top end with a cam and in an outer periphery with a tangent plane;

a connection rod uprightly disposed and provided at a top end with an indentation, said connection rod being pivoted at a bottom end with said machine stand, said connection rod further provided at a midsegment with a protruded piece fastened thereto said connection rod being pivoted with a pulley which is in contact with said cam;

a first slide block horizontally disposed and provided with a first through hole, a second through hole, and a guide hole having a small diametrical end and a large diametrical end, said first slide block further provided in a longitudinal side with a position controlling bolt and a retrieving bolt, said first slide block being fastened to a support plate of said machine stand by two fastening screws which are fastened onto said support plate via said first through hole and said second through hole, said position controlling bolt being retained in said indentation of said connection rod, said retrieving bolt retaining one end of a spring which is retained at another end by a locating bolt fastened to said support plate, said support plate provided with a first guiding hole and a second guiding hole, said first guiding hole and said second guiding hole being corresponding in location to said small diametrical end of said guide hole, said guide hole having a longitudinal hole wall in contact with a pulley, a bolt being fastened onto a seat plate of a main strap feeding wheel of the upright binding machine via said second guiding hole of said support plate such that said bolt catches one end of a spring which is fastened at another end by a screw fastened onto said support plate;

a second slide block horizontally fastened by said first slide block and provided with a long hole parallel to the longitudinal direction of said second slide block and contiguous to said guide hole of said first slide block; and a frame body fastened at one end to a strap guiding frame and provided at another end with an upright shaft which is pivoted to the interior of said machine stand, said frame body further provided in a midsegment with a bolt body which is inserted into said long hole of said second slide block, said frame body further provided with an upright rod body which is fastened to one end of a spring which is in turn fastened at another end to an upright projection extending from said support plate of said machine stand.

* * * * *